US005791111A

United States Patent [19]

Beenders

[11] Patent Number: 5,791,111

[45] Date of Patent: Aug. 11, 1998

[54] SEALING DEVICE FOR A SETTLEMENT JOINT

[75] Inventor: Torsten Beenders, Wuppertal, Germany

[73] Assignee: MIGUA Fugensysteme GmbH, Wulfrath, Germany

[21] Appl. No.: 788,749

[22] Filed: Jan. 24, 1997

[30] Foreign Application Priority Data

Jan. 27, 1996 [DE] Germany ..... 196 02 982.1

[51] Int. Cl.[6] ..... E01C 11/02; E04B 1/68

[52] U.S. Cl. ..... 52/396.05; 52/396.03; 52/396.06; 404/67; 404/68; 404/69

[58] Field of Search ..... 52/393, 396.02, 52/396.03, 396.04, 396.05, 396.06, 396.07, 402, 459, 461, 463, 466, 467, 472, 573.1, 718.04, 717.06; 404/64–69, 49

[56] References Cited

U.S. PATENT DOCUMENTS

| | | | |
|---|---|---|---|
| 4,184,298 | 1/1980 | Blazer et al. | 404/67 X |
| 4,271,650 | 6/1981 | Lynn-Jones | 404/69 X |
| 4,359,847 | 11/1982 | Schukolinski | 52/396.07 |
| 4,735,395 | 4/1988 | Dahowski | 52/396.02 X |
| 5,048,249 | 9/1991 | Shreiner et al. | 52/396.07 |
| 5,584,152 | 12/1996 | Baerveldt | 52/396.04 X |

FOREIGN PATENT DOCUMENTS

| | | | |
|---|---|---|---|
| 3020035 | 1/1985 | Germany . | |
| 3426461 | 10/1985 | Germany | 52/396.03 |
| 4104401 | 8/1992 | Germany . | |
| 2093885 | 9/1982 | United Kingdom | 404/65 |
| 2158120 | 11/1985 | United Kingdom | 404/69 |

*Primary Examiner*—Carl D. Friedman
*Assistant Examiner*—Laura A. Callo
*Attorney, Agent, or Firm*—Paul J. Sutton

[57] ABSTRACT

A sealing device (1) for a settlement joint (2) between two building members (3 and 4) consists of two anchoring units (5) connecting with the building members (3,4), placed on opposite sides of the settlement joint (2), as well as an elastic bridge unit (6). The bridge unit (6) is connected at its longitudinal edges with the anchoring units (5) in such manner that a longitudinal leg (7) of an anchoring unit (5), protruding approximately perpendicularly from the building members (3 or 4), penetrates into an open longitudinal groove (8) in the bridge unit (6), corresponding to the respective building member (3 or 4). To avoid leaks due to assembly defect with certainty and to guarantee ease of assembly, it is proposed that the bridge unit (6) include a rib defining a downwardly open locking groove U-shape at both edges, each said locking groove encompassing a clamp leg (9) of anchoring unit (5), located at the side of the longitudinal leg (7) facing away from the settlement joint (2), also protruding perpendicularly from the building members (3 or 4), a clamp strip of spring material holding the ribs of the bridge member over the clamp legs.

8 Claims, 3 Drawing Sheets

SEALING DEVICE FOR A SETTLEMENT JOINT

BACKGROUND OF THE INVENTION

This invention refers to a sealing device for a settlement joint between two building members, consisting of two anchoring units connected to the building members, placed on opposite sides of the settlement joint, as well as an elastic bridge unit connected along its longitudinal edges with the anchoring units such that an approximately perpendicular longitudinal leg of an anchoring unit, protruding from the building member, penetrates into a longitudinal groove in the bridge unit corresponding to the respective building member.

PRIOR ART

Such a device is, for example, known from DE 41 04 401 C1. With the known device, with each anchoring unit on the side of the longitudinal leg facing away from the settlement joint, a fastener leg, running in the longitudinal direction of the device, is also formed that terminates essentially flush with the top face of bridge unit and a floor covering. On the side facing the longitudinal leg, this fastening leg has a longitudinal groove in which a fitted cleat, movable perpendicularly to the longitudinal run of the joint, is positioned. Tappings, placed at intervals in a longitudinal direction, are inserted into the fastening leg from the upper side, into which tappings headless screws can be screwed. So that the tappings are connected to the longitudinal grooves in the fastening legs in the area of the groove bottom, the cleat is pressed out of the longitudinal groove when the headless screws are screwed in, due the their conical tips. The serrated face of the cleats is thus pressed into the longitudinal side of the bridge unit, consisting of an elastic rubber bridge unit, resulting in a positive connection between the bridge and anchoring unit, particularly with the serrated longitudinal side of the longitudinal leg of the anchoring unit facing the settlement joint.

The construction of the known device is, however, very complicated and requires high expenditures on assembly due to the requirement of accurately inserting a large number of headless screws. The bridge unit, once the device has been assembled, is very difficult to remove, since the cleats do not return to their starting position at the bottom of the groove when the headless screws are removed, so that the positive connection cannot be removed without further effort and damage to the bridge.

An additional generic sealing device for settlement joints is known from DE 30 20 035 C2. With this device, longitudinal marginal strips on the bridge unit are placed on either side of the joint, between a cap strip flush with the floor and an anchoring unit. There are matching drill holes in the cap and corresponding anchoring unit. The drill holes in the anchoring unit are provided with threads. These caps are placed on either side of the settlement joint on the bridge unit and then screwed down, the anchoring units, thus, clamping the bridge units located between the cap and the anchoring unit.

The holes or penetrations in the bridge unit for insertion of the fastening screws are, however, critical points in such a sealing device. Furthermore, such a screw connection between the bridge unit and anchoring unit always means a substantial expense during production and assembly of the profiles and during subsequent replacement of damaged profile parts. It is not uncommon for unprofessional profile assembly or repair to lead to leaks with such devices.

SUMMARY OF THE INVENTION

In accordance with the invention the object is achieved by providing anchoring units at opposite sides of the buildings to be spanned, the units each including an upwardly directed clamp leg which is generally U-shaped in cross-section and which parallels a longitudinal leg projecting upwards in spaced relation to the clamp leg. The bridge unit, adjacent each margin portion, includes an inverted U-shaped configuration which encompasses the clamp leg. A resilient connecting strip, i.e. of spring steel, outwardly laps under pressure, the portions of the bridge member encompassing the clamp leg. Preferably in the clamp leg and strip, the U configuration is narrower at the mouth of the U than at the base to augment the clamping action. The bridge is of generally W-shape in cross-section.

Providing the bridge unit with drill holes or other penetrations through which fastening screws would have to be inserted in the course of a time-consuming assembly thus becomes unnecessary. Screwing down headless screws, to contribute to a positive connection between the elastic rubber bridge unit and a cleat inserted therein, is also not required.

Rather, pursuant to the invention, the bridge unit is attached on both sides of the settlement joint quite simply with a longitudinal groove on a longitudinal leg of the anchoring unit protruding from the building member. At the same time, the bridge unit with its opposing longitudinal marginal strips is fed in a U-shape around the clamp leg also perpendicularly protruding from the building member, parallel to the longitudinal leg. This initial assembly stage, involving loose placement or insertion on the two anchoring units, is followed only by a second assembly stage consisting of clipping or pressing a fitted U-shaped connecting strip of spring steel onto the bridge unit in the areas of each of the clamp legs, thus achieving a frictional connection as well as a certain positive lock between the anchoring unit and the bridge unit due to the U-shape.

In comparison to fastening the bridge unit by means of screws, clipping on the connecting strips requires a minimum of time, thus, clearly reducing assembly costs. It also eliminates the need to keep in stock anchoring units and caps as well as bridge units that are matched in terms of hole spacing.

Finally, the longitudinal leg, introduced in spaced relation to the clamp leg, prevents any tensile stress or compressive strain within the mid-section of the bridge unit from being transferred to the connecting strip or the clamp leg or any connecting joint located between the clamp leg and the face of a floor covering. The longitudinal leg introduced thus works as a sort of tensile stress and compressive strain relief for the actual fastening of the bridge unit to the clamp leg.

Following one method of embodiment of the device pursuant to the invention, it is proposed that the connecting strip terminate essentially flush with the plane of a floor covering and the top of the bridge unit, since an essentially flat surface can thus be achieved in the area of the bridged settlement joint.

If is furthermore particularly advantageous to fill flush any gap between the face of the floor covering and the connecting strip, to achieve a permanent elastic connection.

As a further method of embodiment of the invention, it is proposed that the bridge unit have, between the longitudinal legs of the anchoring units, two cavities placed symmetrically to a middle plane of the bridge unit, running in the longitudinal direction of the settlement joints, between which cavities a longitudinal groove facing away from the settlement joints and arranged perpendicular to the plane of the floor covering be located in the bridge unit, the depth of which is at least one-half the thickness of the bridge unit between the anchoring units.

This method of embodiment is particularly advantageous when a sealing foil separating the floor covering from the building member is to be connected to the anchoring units, which sealing foil is to be bent in a U and pulled up to the bridge unit. This avoids any liquid on the floor covering in the area of the settlement joint reaching one of the building members or entering the area of the settlement joint itself.

Finally, yet another method of embodiment of the invention provides that the bridge unit have a longitudinal groove, between a longitudinal leg and the corresponding clamp leg, into which the connecting strip penetrates, with its groove interior facing the longitudinal leg being fitted to the curvature of the connecting strip in the area of a groove opening.

The opening cross-section of the longitudinal groove can thus be kept particularly small and, even with high tensile stress inside the bridge unit, this longitudinal groove does not expand due to the longitudinal leg absorbing the tensile stress.

The invention is explained in greater detail based on two methods of embodiment presented in the drawings.

DETAILED DESCRIPTION OF DRAWINGS

Figure 1:
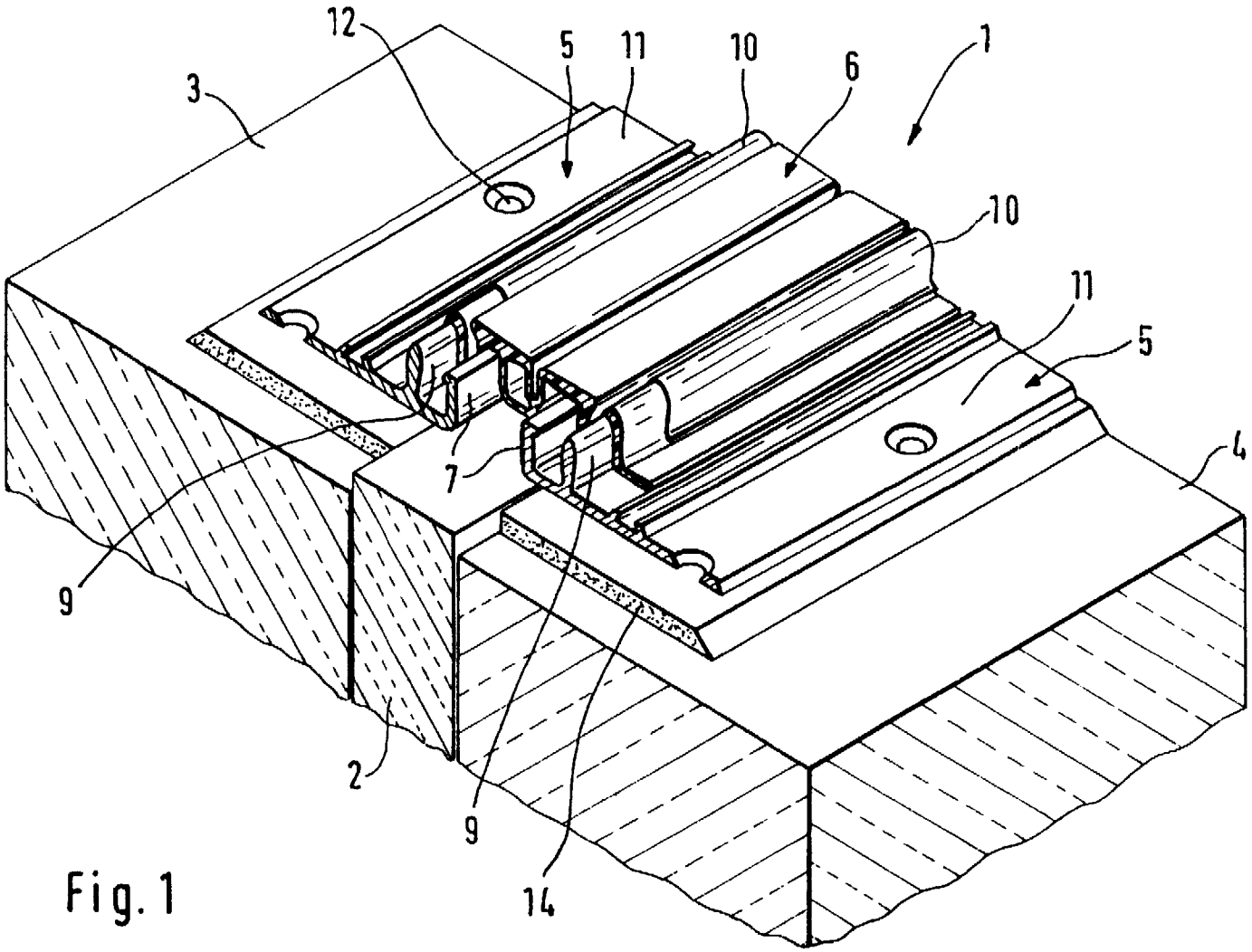
FIG. 1: a sealing device for a settlement joint in a perspective cross-section.
Figure 2:
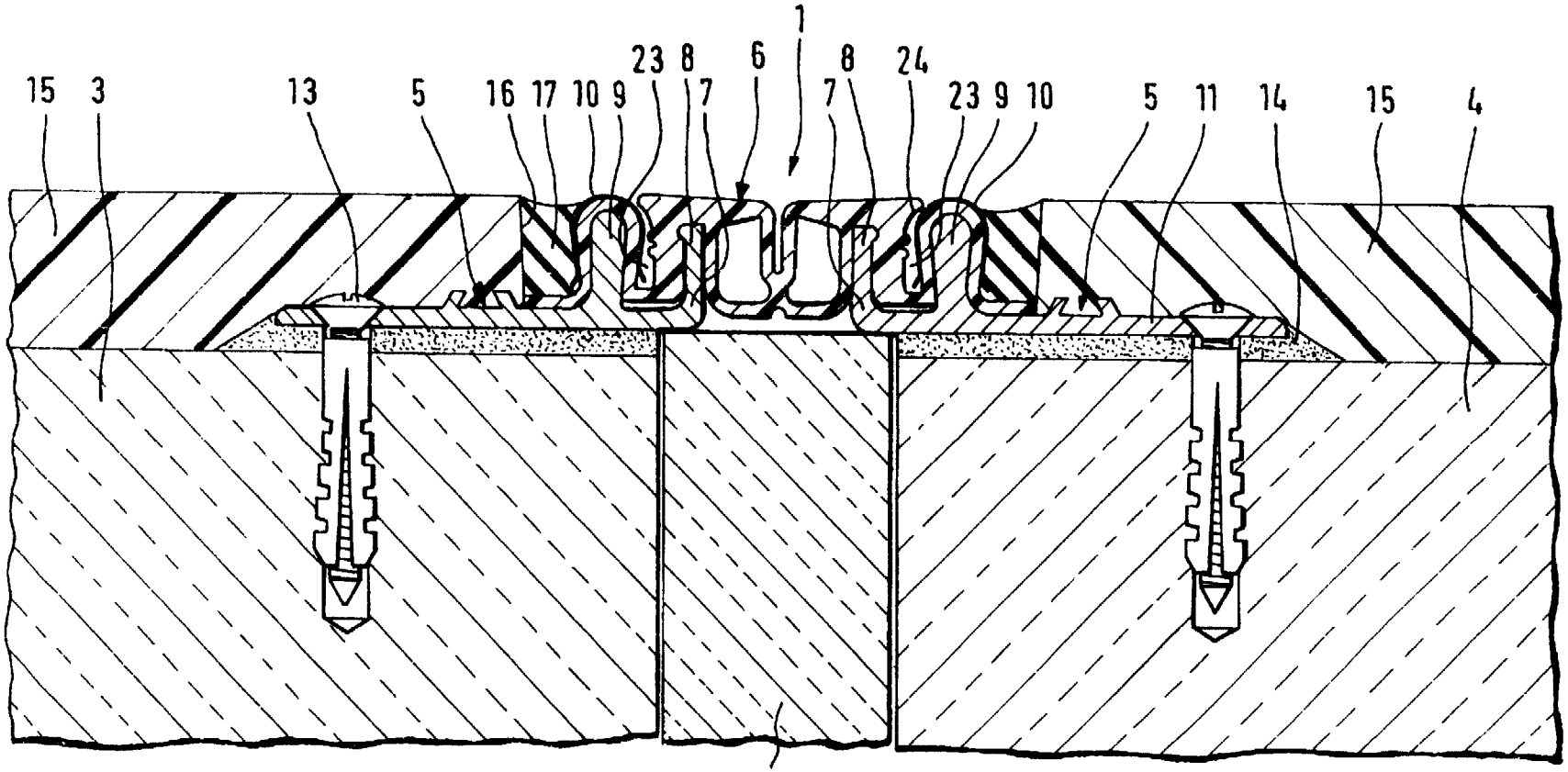
FIG. 2: the device pursuant to FIG. 1 in cross-section, with the floor covering applied.

FIGS. 1 and 2 show a sealing device 1 for settlement joint 2 filled with an insulating material, which joint is located between two building members 3 and 4. Sealing device 1 consists of two anchoring units 5 placed on opposite sides of settlement joint 2, connected with building members 3 and 4, as well as elastic bridge unit 6. Bridge unit 6 is connected at its longitudinal edges with anchoring units 5 in such manner that longitudinal leg 7 of anchoring unit 5, protruding approximately perpendicularly from building members 3, 4, penetrates into open longitudinal groove 8 in bridge unit 6 currently corresponding to building members 3,4.

Anchoring units 5 are, moreover, provided with clamp leg 9, placed parallel to longitudinal leg 7, on the side of longitudinal leg 7 facing away from settlement joint 2, around which bridge unit 6 runs in U-shape in the area of the currently corresponding longitudinal edge. At this clamp leg 9, also protruding perpendicularly from corresponding building members 3, 4, bridge unit 6 is fastened to fitted U-shaped connecting strip 10 of stainless spring steel. Due to the extreme pre-stress on connecting strip 10, a highly effective positive connection is created between rib portion of bridge 6 surrounding the clamp leg and clamp leg 9 of anchoring units 5. Due to the U-shape of clamp leg 9 and the fitted U-shape of connecting strips 10, there is a further degree of positive connection between anchoring units 5 and bridge unit 6. The U-shape of the leg 9 encompassed by the rib defining a downwardly open groove of the bridge unit and the strip 10 are such that the mouth of the U is narrower than the base of the U, i.e. the walls of the U converge from the base toward the mouth.

As can be seen in FIG. 1, connecting leg 11 of anchoring units 5, with an F-shaped cross-section, is provided in an edge area with sunken open drill holes 12 placed at intervals along the longitudinal direction of sealing device 1, which drill holes have countersinks which serve to accept the lenticular heads of screws 13.

Before assembly of anchoring units 5, equalizing filler 14 is applied to the edge areas of building members 3 and 4 near the joint, to create a level, stable surface for connecting leg 11 of anchoring units 5. After assembly of anchoring units 5 and bridge unit 6, floor covering 15 is applied and then any gap between face 16 of floor covering 15 and connecting strip 10 is filled with sealer 17, essentially flush with the plane of floor covering 15.

Figure 3:
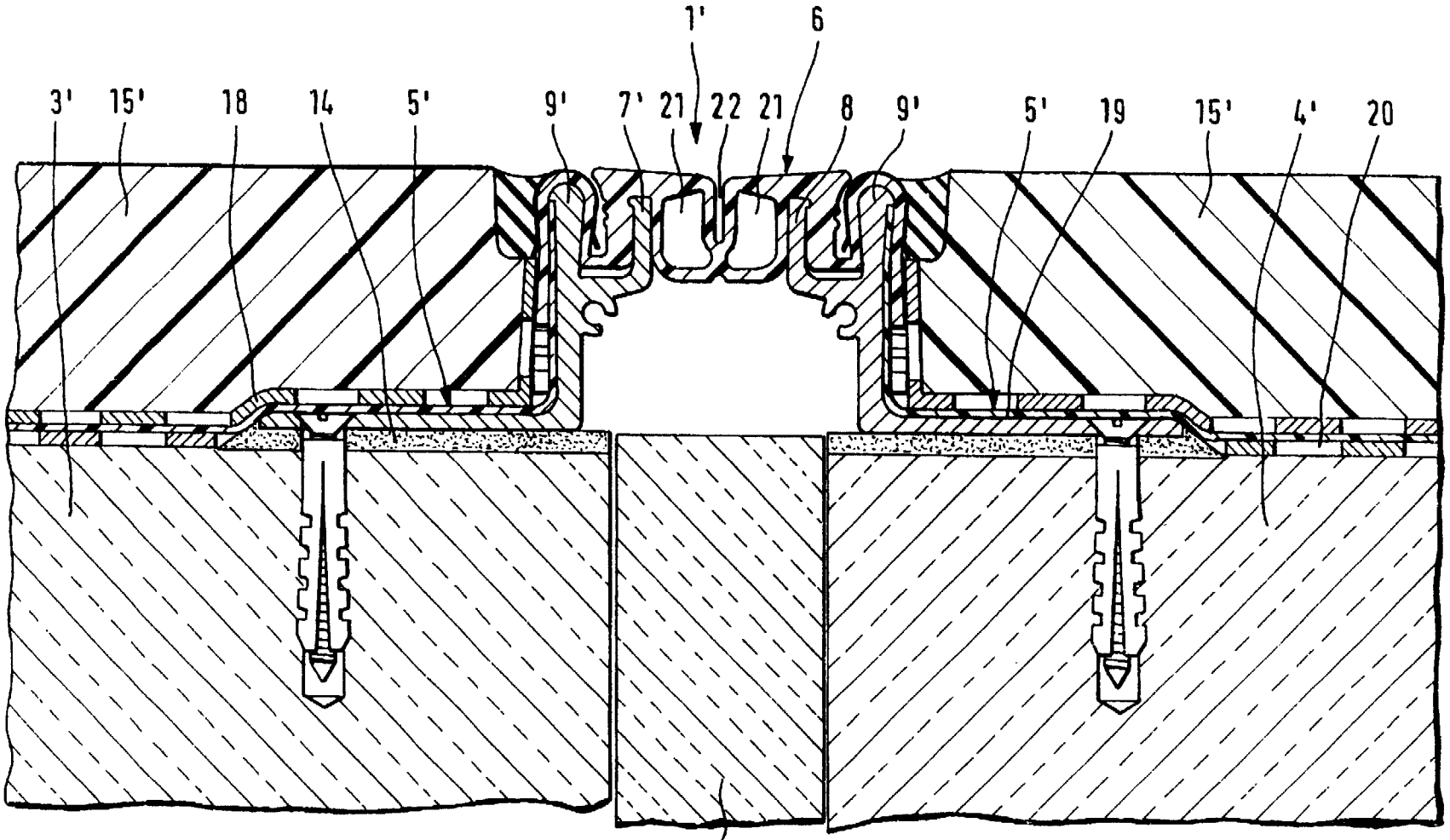
FIG. 3: an alternative sealing device in cross-section, with an essentially L-shaped anchoring unit.

FIG. 3 shows alternative sealing device 1', in which anchoring units 5' are formed with an essentially L-shaped cross-section. Additional longitudinal leg 7', also L-shaped, with its free end away from settlement joint 2, is placed at the free L-leg, formed as clamp leg 9', on a side corresponding to settlement joint 2. This longitudinal leg 7' penetrates into longitudinal groove 8 in bridge unit 6, which is identical to the arrangement shown in FIG. 2.

There is a film consisting of three layers, 18, 19 and 20, between building members 3' and 4' and corresponding floor coverings 15'.

FIGS. 2 and 3 show that bridge unit 6 has two cavities 21 placed symmetrically to longitudinal legs 7 or 7' of anchoring units 5 or 5', extending in the longitudinal direction of settlement joint 2. Between these cavities 21 is longitudinal groove 22 in bridge unit 6, facing away from the settlement joints and placed perpendicular to the plane of floor coverings 15 or 15'. The depth of this longitudinal groove 22 is at least one-half the thickness of bridge unit 6 in the area between anchoring units 5. Through this method of embodiment of bridge unit 6, a high degree of fit is achieved with both horizontal and vertical introductions of building members 3 or 3' and 4 or 4'.

Finally, FIGS. 2 and 3 show that bridge unit 6 has longitudinal groove 23 between one longitudinal leg 7 or 7' and the corresponding clamp leg 9 or 9'. Connecting strip 10 penetrates into this longitudinal groove 23 with one of its free legs. Furthermore, groove interior 24 facing longitudinal leg 7 and 7' is fitted, in the area of a groove opening, to the curvature of connecting strip 10, always resulting in a very small opening for longitudinal groove 23, independent of the temporary introduction position of building members 3 or 3' and 4 or 4' to be bridged. Smooth, seamless bridging of settlement joint 2 is possible with sealing device 1 or 1', since connecting strip 10 connects essentially flush with the plane of floor covering 15 and 15' and the top of bridge unit 6.

As will be apparent to skilled workers in the art familiarized with the instant disclosure, numerous variations may be made without departing from the spirit of the invention. Accordingly, the invention is to be broadly construed within the scope of the appended claims.

I claim:

1. In a sealing device for a settlement joint disposed between two building members, said sealing device comprising a pair of anchoring units each adapted to be secured to a respective said building member, each said anchoring unit including a longitudinal leg at an inner edge thereof protruding upwardly substantially perpendicular to said unit, an elastic bridge member spanning said anchoring units, said bridge member including side margin portions, each said margin portion having a downwardly directed groove encompassing a said longitudinal leg of a respective said anchoring unit, the improvement which comprises each said anchoring unit including a clamp leg in spaced parallel relation to a said longitudinal leg, said side margin portions of said bridge member each including rib member having a downwardly open U-shaped locking groove encompassing a respective said clamp leg, and a resilient inverted U-shaped connecting strip overlying each said rib member and clampingly retaining a said clamp leg within a said locking groove.

2. A device in accordance with claim 1 wherein the legs of said U-shaped locking groove, clamp leg and connecting strip are inclined toward each other whereby the base of said U-shaped portions is wider than the mouth of said portions.

3. A device in accordance with claim 1 wherein said connecting strips are in stressed condition against said rib members.

4. A device in accordance with claim 3 wherein said connecting strips are comprised of spring steel.

5. A device in accordance with claim 1 wherein said bridge member includes a spaced pair of longitudinally extending cavities symmetrically disposed to opposite sides of the longitudinal center line of the said member, said bridge member including an upwardly open, longitudinally extending groove interposed between said cavities.

6. A device in accordance with claim 5 wherein the depth of said longitudinally extending groove is at least about one-half of the thickness of said bridge member.

7. A device in accordance with claim 1 wherein said anchoring units have a generally F-shaped cross-section.

8. A device in accordance with claim 1 wherein said bridge member is generally W-shaped in cross-section.

* * * * *